US009022694B2

(12) United States Patent
Hill

(10) Patent No.: US 9,022,694 B2
(45) Date of Patent: May 5, 2015

(54) SYSTEM AND APPARATUS FOR REPAIRING A FOUNDATION

(71) Applicant: Michael Hill, Sugarland, TX (US)

(72) Inventor: Michael Hill, Sugarland, TX (US)

( * ) Notice: Subject to any disclaimer, the term of this patent is extended or adjusted under 35 U.S.C. 154(b) by 0 days.

(21) Appl. No.: 13/754,368

(22) Filed: Jan. 30, 2013

(65) Prior Publication Data

US 2014/0212223 A1 Jul. 31, 2014

(51) Int. Cl.
*E02D 5/30* (2006.01)
*E02D 37/00* (2006.01)
*E02D 5/52* (2006.01)

(52) U.S. Cl.
CPC ..... *E02D 37/00* (2013.01); *E02D 5/526* (2013.01)

(58) Field of Classification Search
CPC ..... E02D 5/30
USPC ..... 405/230, 251, 252
See application file for complete search history.

(56) References Cited

U.S. PATENT DOCUMENTS

| | | | | |
|---|---|---|---|---|
| 3,299,644 | A * | 1/1967 | White | 405/230 |
| 3,899,891 | A * | 8/1975 | Kelly et al. | 405/251 |
| 5,505,561 | A * | 4/1996 | Willcox, III | 405/251 |
| 6,951,437 | B2 * | 10/2005 | Hall | 405/253 |
| 7,429,149 | B2 * | 9/2008 | Price et al. | 405/257 |
| 8,500,368 | B1 * | 8/2013 | Deshazer et al. | 405/230 |
| 2005/0019103 | A1 * | 1/2005 | Brooks et al. | 405/230 |
| 2010/0021244 | A1 * | 1/2010 | Dimitrijevic | 405/256 |
| 2010/0080658 | A1 * | 4/2010 | Marshall | 405/232 |

* cited by examiner

*Primary Examiner* — Sunil Singh
(74) *Attorney, Agent, or Firm* — Bushman Werner, P.C.

(57) ABSTRACT

A foundation repair system comprising a starter pile, a cable, a stop, and at least one piling segment. The starter pile includes an elongate housing and a base with an opening therethrough. The cable extends from the elongate housing, through the base and through the piling segments. The piling segments include a first portion with a first cross-sectional area and a second portion with a second-smaller cross-sectional area, the second portion of one piling segment resting atop the first portion of the lower piling segment.

12 Claims, 2 Drawing Sheets

FIG. 1
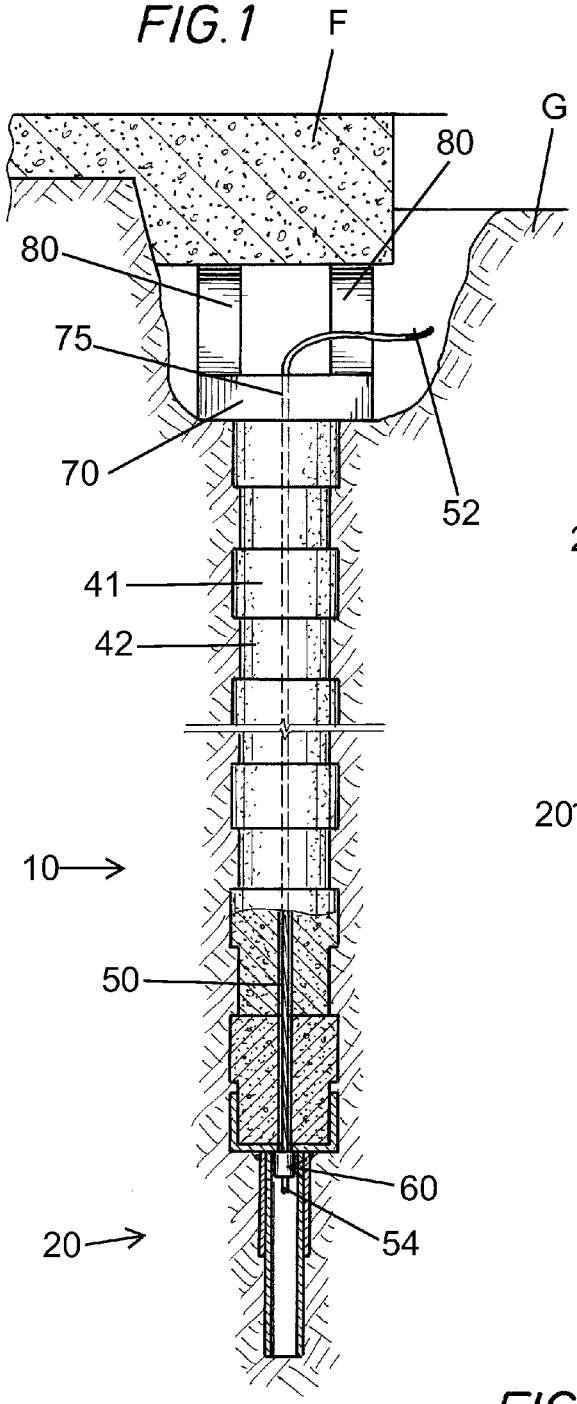
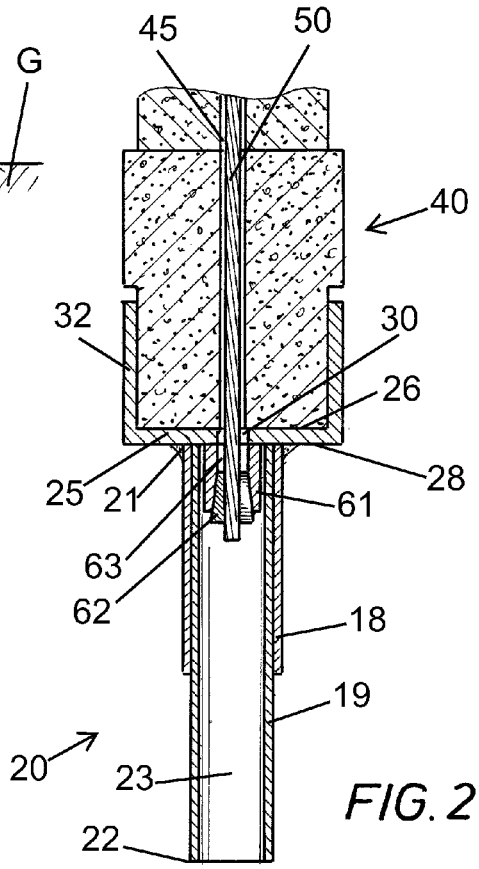
FIG. 2
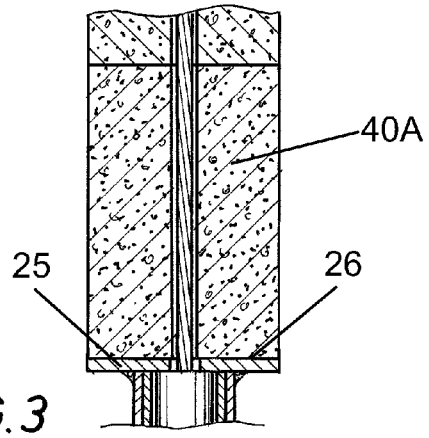
FIG. 3

FIG. 4
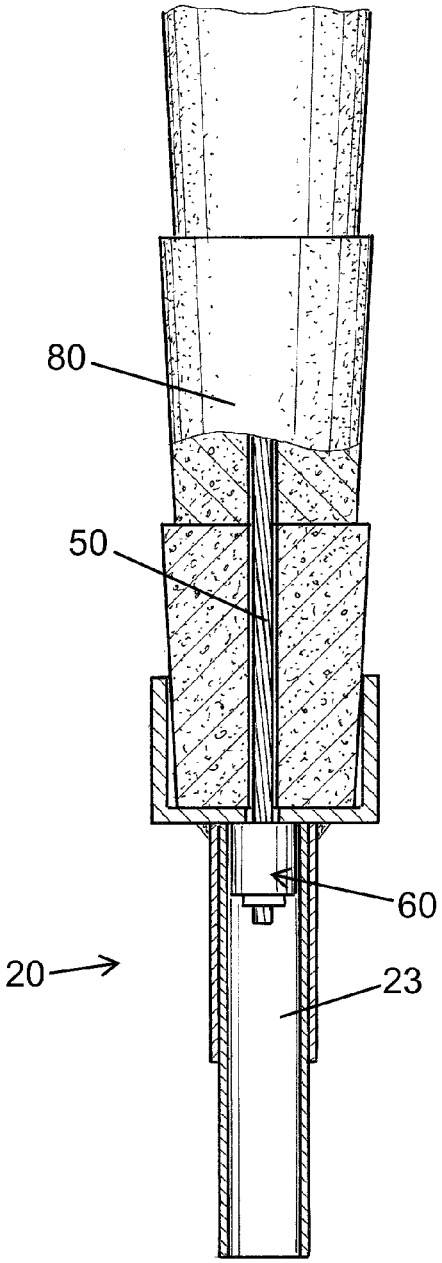
FIG. 5
(PRIOR ART)
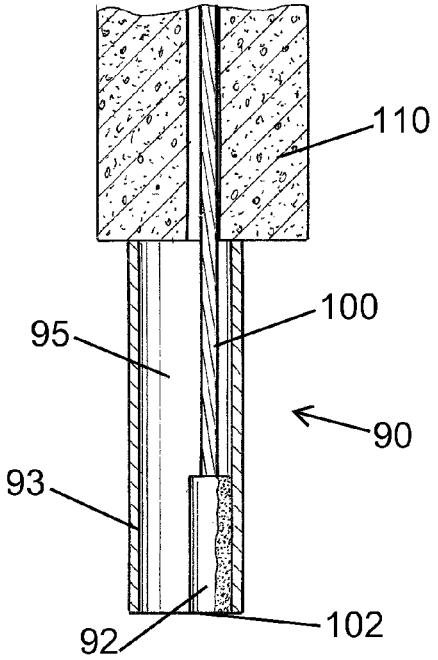
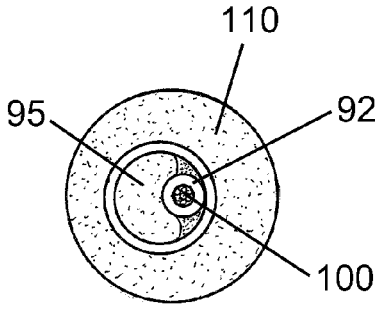
FIG. 6
(PRIOR ART)

SYSTEM AND APPARATUS FOR REPAIRING A FOUNDATION

FIELD OF THE INVENTION

The present invention relates to foundation repair and, more particularly, to a cable system for leveling and/or raising a foundation.

BACKGROUND OF THE INVENTION

Various techniques are available today in order to repair a sinking, sagging, or broken concrete foundation. Foundation (slab) damage is caused by unstable ground beneath and/or around the foundation. This can be a result of soil conditions, tree roots invading the area, plumbing leaks, poor drainage, etc. To repair the damage, it is usually necessary that pilings or other supports be driven into the ground below the foundation and shimmed to level the slab. This support can come in a variety of forms.

One of the most common forms of foundation leveling or repair is known as the cable technique. In the general cable method, concrete pilings are driven into the ground, one atop another until they reach the point of refusal or at least more stable strata. These pilings generally have a bore or opening extending axially therethrough. A braided metal cable is threaded through the openings in the pilings during driving in order to ensure alignment of the pilings and to ensure the pilings do not buckle during the driving process. The number of pilings required in a cable system is dependent on the needs of the particular foundation and the nature of the soil.

In a typical cable system, an initial piece or starter pile is used. The starter pile is generally of a smaller cross-sectional area than the rest of the pilings to facilitate driving of the pilings into the ground and to achieve a greater depth. In general, it is believed that the greater depth achieved by the pilings, the stronger the foundational support.

As noted, a commonly employed foundation repair system employs a length of cable which extends from the lowermost piling section to the surface. It is important that the depth of the borehole, and hence the depth of the pilings beneath the foundation, can be accurately determined should future repairs be necessary. Accordingly, the end of the cable which sticks out the top of the pilings is generally color coded indicating various lengths of cable. It is important that the cable be securely locked to the starter pile such that it cannot be pulled up through the pilings during or subsequent to the installation process.

Typically, the lowermost end of the braided cable is capped with a fitting and then fixedly secured to the starter pile. The most common form of anchoring the cable is to weld the fitting to the inside of the starter pile, though it may be secured by adhesives or the like as well. Accordingly, the starter pile and cable form a single component.

Rather than have the installers of the cable system perform the welding on site to secure the cable to the starter pile, the cable is sold with the fitting attached and pre-welded to the starter pile. In order to ensure that they have the right length of cable in stock without wasting cable, the installers must pre-purchase a variety of different length cables pre-welded to starter piles, e.g. ten foot, fifteen foot, twenty foot, etc. This can be costly and inefficient for the installers.

SUMMARY OF THE INVENTION

In one aspect, the present invention provides a system for repairing a foundation.

In another aspect, the present invention provides an apparatus for use with a foundation repair system.

In yet another aspect, the present invention provides a piling segment for use in a foundation repair system.

These and further features and advantages of the present invention will become apparent from the following detailed description, wherein reference is made to the figures in the accompanying drawings.

BRIEF DESCRIPTION OF THE DRAWINGS

FIG. 1 is an environmental view, partly in section, showing one embodiment of the foundation repair system of the present invention.

FIG. 2 is an elevational view, in cross-section, of the apparatus of the present invention.

FIG. 3 is an elevational view, partly in section, of another embodiment of the apparatus of the present invention.

FIG. 4 is an elevational view, partly in section of another embodiment of the foundation repair system of the present invention.

FIG. 5 is an elevational view, partly in section of a prior art starter pile.

FIG. 6 is a top view of the prior art starter pile shown in FIG. 5.

DETAILED DESCRIPTION OF PREFERRED EMBODIMENTS

Referring first to FIG. 1, there is one embodiment, shown generally as 10, of the foundation repair system of the present invention used to repair foundation F resting of the ground G. System 10 includes a starter pile, shown generally as 20. As best seen in FIG. 2, starter pile 20 has a first end 21, a second end 22, and a peripheral wall defining a housing 23. As shown, starting pile 20 is comprised of tubes 18 and 19 secured together, but it could be formed by a single tube if desired. Attached to first end 21, as by welding, is a base 25. Base 25 has a first side 26, a second side 28 and a hole 30 extending therethrough. Cable 50 slidably extends through hole 30 of base 25. Cable 50 has a first end 52 and a second end 54. Second end 54 of cable 50 is received in housing 23 of starter pile 20. A stop or anchor 60 is secured to second end 54 of cable 50. Although cable 50 is slidably movable through hole 30 of base 25, stop 60 prevents the complete removal of second end 54 of cable 50 from housing 23. Positioned on first side 26 of base 25 is a piling segment, shown generally as 40. Piling segment 40 has a passageway 45 extending axially therethrough such that piling segment 40 may be threaded along cable 50.

It will be appreciated that the system of the present invention can employ as many or as few piling segments 40 as are required to attain the desired depth to support foundation F. As best seen in FIG. 1, in a system employing a plurality of piling segments 40, cable 50 extends from housing 23 of starter pile 20 and through the passageways 45 of piling segments 40. Cable 50 adds stability and alignment to the system and prevents the stacked piling segments 40 from buckling as they are driven into the ground, as well as ultimately providing readable depth in post-installation adjustments as needed.

Positioned atop the uppermost piling segment 40 is a cap block 70. Cap block 70 has an aperture 75 extending axially therethrough. First end 52 of cable 50 extends through aperture 75 of cap block 70. Also shown are supports 80 positioned between cap block 70 and foundation F. Further, shims may be used to provide the desired degree of leveling of foundation F between supports 80 and foundation F.

Turning now to FIG. 2, there is shown in greater detail the starter pile of the present invention. In a preferred embodiment, base 25 includes an annular wall 32 attached to first side 26. Annular wall 32, together with first side 26 of base 25, defines a receiving formation for receiving a piling segment 40.

Stop 60 comprises an annular body 61 having a tapered bore 63 extending axially therethrough. Cable 50 extends through tapered bore 63 and is locked in place by a plurality of wedge-shaped segments 62 in surrounding relationship to cable 50. In practice, wedge-shaped segments 62 are forced into bore 63 by a hydraulically activated annular piston such that cable 50 becomes securely locked into stop 60. It will be appreciated that because of the unique design of stop 60, upward tension on cable 50 causes wedge-shaped segments 62 to more tightly engage cable 50.

FIG. 3 shows another embodiment of the present invention wherein annular wall 32 has been dispensed with, such that piling segment 40A can rest on first 26 of base 25. Further, as also shown in FIG. 3, piling segment 40A is of uniform cross-sectional shape, as opposed to piling segment 40 which, as described above has portions having differing cross-sectional areas.

In a preferred embodiment of the present invention, piling segments 40 have a first portion 41 with a first cross-sectional area and a second portion 42 with a second, smaller cross-sectional area. In a preferred embodiment (and as shown in FIG. 1), piling segments 40 are configured in such a way that the second portion 42 of one piling segment sits atop the first portion 41 of a lower piling segment.

FIG. 4 shows another embodiment of the system of the present invention. FIG. 4 differs from FIG. 1 only in that the system of FIG. 4 employs piling segments 80 which are frustoconical and configured such that the smaller diameter end of one piling segment 80 sits atop the larger diameter end of the lower piling segment 80. It will be appreciated that such a configuration of piling segments 80 decreases wall friction with the bore in ground G into which the piling segments 80 are driven, i.e., the tapered shape of the piling segments 80 helps reduce resistance as the pilings segments are driven into the ground G. This allows the installers to achieve greater depth.

Turning now to FIG. 5, there is shown a representation of a prior art starter pile 90. Starter pile 90 includes an elongate housing 95. The first end (not shown) of cable 100 extends through the piling segments 110 while second end 102 of cable 100 extends into a fitting 92 which is attached, i.e., welded to the inner wall 93 of housing 95. While cable 100 is generally attached by welding fitting 92, it could also be secured through the use of various adhesives. It is further shown in FIG. 5 that piling segment 110 is resting directly on the elongate portion of starter pile 90. Unlike the apparatus of the present invention, prior art starter pile 90 lacks an attached base to support piling segment 110. In order to better support piling segment 110, prior art systems require a separate support or transition piece (not shown). Finally, piling segment 110 is of a single cross-sectional area, unlike the preferred piling segments of the present invention. FIG. 6 shows a top view of prior art embodiment shown in FIG. 5.

It will be appreciated that the present invention provides several distinct advantages over the prior art. For instance, the starter pile of the present invention provides greater flexibility for the users/installers of the system. For any given installation job, the installers needed to purchase cables of varying lengths with starter piles prewelded. The exact length of cable needed for a job is not always discernible until work has already begun. Alternatively, the installer could simply purchase the longest cable available with the starter pile prewelded. This would result in excess cable that was simply not used. These two alternatives are costly and/or inefficient. Using the system of the present invention, for any given installation job, the installers need only purchase a single starter pile and separate cables of various lengths.

The configuration of the piling segments described above provides a distinct advantage. The smaller cross-sectional area of the piling segments at the lower end reduces the surface friction as the piling segment is driven. By reducing the friction, the piling segments are able to reach the desired depth and achieve a greater depth before friction prevents further driving. By achieving greater depths, the system of the present invention provides a better support for the foundation.

The system of the present invention virtually eliminates the problems of prior art foundation systems employing cables and piling segments.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. An apparatus for use in repairing a foundation, comprising:

an elongate, tubular starter pile, said starter pile comprising a first tubular section forming a first end and having a first diameter and a second tubular section forming a second end axially spaced from said first end and having a second, smaller diameter;

a base having a top side and a bottom side and an annular wall connected to said top side of said base and defining a receiving formation, said bottom side being secured to said first end of said starter pile, said base having a hole extending therethrough;

a cable having a first end and a second end and slidably extending through said hole, said second end extending into said starter pile; and a stop secured to said second end of said cable for preventing said second end of said cable from being pulled out of said starter pile through said hole in said base, said stop being movable in said starter pile, upward tension on said cable in a direction toward said bottom side of said base effecting engagement of said stop with said bottom side of said base.

2. The apparatus of claim 1, wherein said cable is mechanically connected to said stop.

3. The apparatus of claim 2, wherein said stop comprises a body having a first end and a second end, a tapered bore having its smallest cross-section proximal said first end of said stop, said cable being received through said bore, at least two wedge shaped locking members received in said larger end of said bore and in surrounding relationship to said cable to lock said cable in said stop.

4. A system for use in repairing a foundation, comprising:

an elongate, tubular starter pile, said starter pile comprising a first tubular section forming a first end and having a first diameter and a second tubular section forming a second end axially spaced from said first end and having a second, smaller diameter;

a base having a top side and a bottom side and an annular wall connected to said top side of said base and defining a receiving formation, said bottom side being secured to said first end of said starter pile, said base having a hole extending therethrough;

a cable having a first end and a second end and slidably extending through said hole, said second end extending into said starter pile;

a stop secured to said second end of said cable for preventing said second end of said cable from being pulled out of said starter pile through said hole in said base, said stop being movable in said starter pile, upward tension on said cable in a direction toward said bottom side of said base effecting engagement of said stop with said bottom side of said base; and a first piling segment having a first piling segment end received in said receiving formation, said piling segment having a passageway extending axially therethrough, said cable extending through said passageway.

5. The system of claim 4, wherein said cable is mechanically connected to said stop.

6. The system of claim 5, wherein said stop comprises a body having a first end and a second end, a tapered bore having its smallest cross-section proximal said first end of said stop, said cable being received through said bore, at least two wedge shaped locking members received in said larger end of said bore and in surrounding relationship to said cable to lock said cable in said stop, said first end of staid stop being positioned proximal said second side of said base.

7. The system of claim 4, wherein first said piling segment has a first portion having a first cross-sectional area and a second portion having a second, smaller, cross-sectional area, said first piling segment end being formed on said second portion.

8. The system of claim 4 further comprising:

a plurality of additional piling segments axially aligned atop said first piling segment, each of said additional piling segments having a passageway extending axially therethrough, said cable extending through said passageway; and a cap block disposed atop the uppermost of said piling segments, said cap block having an aperture extending axially therethrough.

9. The system of claim 8, wherein said cable is mechanically connected to said stop.

10. The system of claim 9, wherein said stop comprises a body having a first end and a second end, a tapered bore having its smallest cross-section proximal said first end of said stop, said cable being received through said bore, at least two wedge shaped locking members received in said larger end of said bore and in surrounding relationship to said cable to lock said cable in said stop, said first end being positioned proximal said second side of said base.

11. The system of claim 8, wherein each of said additional piling segments has a first portion having a first cross-sectional area and a second portion having a second, smaller cross-sectional area.

12. The system of claim 11, wherein each of said additional piling segments are disposed axially in an end-to-end configuration such that the second portion of one additional piling segment is atop the first portion of the proximal additional piling segment.

* * * * *